US006037568A

United States Patent [19]

Hatanaka et al.

[11] Patent Number: 6,037,568

[45] **Date of Patent: *Mar. 14, 2000**

[54] GLOW PLUG FOR DIESEL ENGINE WITH PTC CONTROL ELEMENT DISPOSED IN SMALL-DIAMETER SHEATH SECTION AND CONNECTED TO THE DISTAL END THEREOF

[75] Inventors: Koji Hatanaka; Takashi Aota, both of Saitama, Japan

[73] Assignee: Jidosha Kiki Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/781,806

[22] Filed: Jan. 10, 1997

[30] Foreign Application Priority Data

Jan. 18, 1996 [JP] Japan ..... 8-006404

[51] Int. Cl.[7] ..... F23Q 7/22

[52] U.S. Cl. ..... 219/270; 219/260; 219/264

[58] Field of Search ..... 219/260–270, 219/544, 542; 123/145 A, 145 R; 361/264–266

[56] References Cited

U.S. PATENT DOCUMENTS

| | | | |
|---|---|---|---|
| 4,733,053 | 3/1988 | Mueller | 219/270 |
| 5,039,839 | 8/1991 | Masaka et al. | 219/270 |
| 5,118,921 | 6/1992 | Aota | 219/270 |
| 5,132,516 | 7/1992 | Hatanaka et al. | 219/270 |
| 5,206,483 | 4/1993 | Aota | 219/270 |
| 5,521,356 | 5/1996 | Bauer | 219/270 |

FOREIGN PATENT DOCUMENTS

| | | | |
|---|---|---|---|
| 602745 | 6/1994 | European Pat. Off. | 219/270 |
| 607872 | 7/1994 | European Pat. Off. | 219/270 |
| 54-60630 | 5/1979 | Japan . | |
| 57-87535 | 6/1982 | Japan . | |
| 57-182026 | 11/1982 | Japan . | |
| 3-99122 | 4/1991 | Japan . | |
| 5-264034 | 10/1993 | Japan | 219/270 |
| 6-300262 | 10/1994 | Japan | 219/270 |

*Primary Examiner*—Mark Paschall
*Assistant Examiner*—Shawntina Fuqua
*Attorney, Agent, or Firm*—Blakely Sokoloff Taylor & Zafman

[57] ABSTRACT

A glow plug for a diesel engine includes a heat generating coil, a control coil, a sheath, an electrode rod, and a housing. The heat generating coil serves as a heater element. The control coil is connected in series with the heat generating coil and serves as a controller for controlling power supply to the heat generating coil. The control coil has a positive temperature coefficient of resistance larger than that of the heat generating coil. The sheath accommodates the heat generating coil and the control coil to be embedded in a heat-resistant insulating powder. The sheath has an elongated small-diameter portion on a distal end side thereof and a large-diameter portion on a rear end side thereof. The heat generating coil is connected to an inner wall of a distal end of the small-diameter portion of the sheath. The electrode rod has a distal end portion to which one end of the control coil is connected. The housing supports a rear end portion of the sheath on the distal end side thereof, and the electrode rod. The heat generating coil is disposed in a distal end portion of the small-diameter portion of the sheath, and the control coil is disposed to extend from the small-diameter portion to the large-diameter portion of the sheath.

27 Claims, 4 Drawing Sheets

GLOW PLUG FOR DIESEL ENGINE WITH PTC CONTROL ELEMENT DISPOSED IN SMALL-DIAMETER SHEATH SECTION AND CONNECTED TO THE DISTAL END THEREOF

BACKGROUND OF THE INVENTION

The present invention relates to a glow plug for a diesel engine which is used for improving the starting characteristics of the diesel engine and, more particularly, to a glow plug for a diesel engine in which a small-diameter portion formed on the distal end side of a sheath type heater (to be referred to as a sheath heater hereinafter) is axially extend to form an elongated portion, thereby coping with an increase in number of valves of the diesel engine.

As a glow plug used for improving the starting characteristics of a diesel engine, ones having various types of structures are conventionally known. In Japanese Patent Laid-Open Nos. 57-182026 and 3-99122, the present applicant has previously proposed a self-temperature control type glow plug having a function as a fast-heating type device and a heat saturation function with which overheating of a heat generating portion is prevented to provide stable heat generating characteristics, by combining resistors made of two types of materials.

More specifically, a glow plug of this type has a sheath heater in which the first helical resistor (to be referred to as the first resistor hereinafter) serving as a heater element and the second helical resistor (to be referred to as the second resistor hereinafter) made of a material having a larger positive temperature coefficient of resistance than that of the first resistor are connected in series and are embedded in a heat-resistant insulating powder in a metal sheath.

In particular, with this sheath heater, if a large power is supplied to the first resistor immediately after the first resistor is turned on, the first resistor quickly generates heat, thus obtaining a function as a fast-heating type sheath heater. Also, in the lapse of a predetermined period of time, the temperature increases to increase the resistance of the second resistor. This makes power to be supplied to the first resistor constant or decrease in order to prevent fusing of the first resistor caused by overheating, thus providing a so-called self-temperature control function. Furthermore, in this structure, since a temperature control means for controlling the power supply need not be provided on a power supply circuit that supplies power to the glow plug, the cost of the entire preheating device can be kept low.

The glow plug of this type is demanded to have so-called overshoot characteristics in which the red heating characteristics at the distal end of the sheath heater are improved so that the glow plug serves as a fast-heating type device and that heat having a temperature lower than the maximum temperature is generated for a predetermined period of time in the after-glow time after the engine is started. For this purpose, there is conventionally proposed a glow plug in, e.g., Japanese Patent Laid-Open Nos. 54-60630, 57-87535, and the like, having a sheath heater as a combination of two types of resistors of different resistances as described above, in which the distal end of the sheath where the first resistor is embedded is formed as a small-diameter portion, so that it has a smaller heat capacity than that of the large-diameter portion of the sheath where the second resistor is embedded.

In the conventional diesel engine glow plug described above, when the sheath heater is to be formed by disposing the first and second resistors in the sheath constituted by the small-diameter portion and the large-diameter portion which are obtained by reducing the diameter of the distal end of the sheath, problems as follows arise.

These problems will be described in detail. The glow plug of this type is mounted in a plug holding hole formed in the cylinder head of a diesel engine, such that the distal end of the sheath heater opposes a combustion chamber or a sub-combustion chamber with a predetermined projecting amount through an insertion hole formed in the distal end of the holding hole. Recently, the hole diameter of the insertion hole tends to be formed as small as possible and the length of the insertion hole tends to increase.

The reason of the above tendency is as follows. In recent years, the diesel engine is required to cope with exhaust gas control, and the numbers of intake valves and exhaust valves must be increased as a part of the countermeasure for this requirement. More specifically, many intake valves and exhaust valves are provided on a cylinder head where the glow plug is mounted. In order to ensure the areas of the valve ports of these valves at the maximum, the mounting portion of the glow plug must be small. Also, the strength of the cylinder head must also be ensured. Accordingly, in this cylinder head, the holding hole for mounting the glow plug, in particular the insertion hole for inserting the distal end of the sheath heater, must be formed as small as possible while it must be formed long.

In view of these demands for the cylinder head, on the glow plug side, the length of the small-diameter portion at the distal end of the sheath must be increased to be larger than that of the conventional small-diameter portion. In the conventional sheath heater structure, however, since the first resistor serving as the heater element is arranged in the small-diameter portion, and the second resistor serving as the controller is arranged in the taper portion or large-diameter portion, if the small-diameter portion is merely extended, desired heat generating characteristics as the sheath heater cannot be obtained.

More specifically, in the structure in which the small-diameter portion of the sheath is extended and the first resistor is arranged on the distal end side of the extended small-diameter portion and the first resistor is connected to the second resistor arranged in the taper portion or large-diameter portion of the sheath at a predetermined space through a linear electrical connecting portion, control of the power supply by means of the second resistor is delayed depending on the size of the space between the first and second resistors, and the temperature generated by the sheath heater can be excessively, undesirably increased.

In the sheath heater proposed in Japanese Patent Laid-Open No. 57-87535, the first resistor is arranged in the small-diameter portion of the sheath, the second resistor is arranged in the large-diameter portion of the sheath, and the first and second resistors are connected to each other near the taper portion that couples the small-diameter and large-diameter portions of the sheath. In this structure, since the elongated small-diameter portion is heated by the first resistor, efficient red heating at the distal end of the sheath cannot be achieved. In addition, since the electrical connecting portion between the first and second resistors is located at the taper portion whose size tends to vary during formation of the small-diameter portion of the sheath, the heat generating characteristics of the sheath heater vary, thus rendering the precision unstable.

When increasing the length of the small-diameter portion of the distal end of the sheath, the first resistor may be simply arranged in this small-diameter portion uniformly at a predetermined pitch. In such a structure, however, heat generated by the first resistor is dispersed to the entire portion of the small-diameter portion, and thus so that the heat generated by the small-diameter portion has a low temperature. In the glow plug of this type, the position where the temperature of heat generated by the sheath heater becomes the maximum ranges between the distal end of the sheath and a position thereof at a length corresponding to almost the diameter of the sheath. In the structure described above, the temperature at the central position of the elongated small-diameter portion becomes the maximum. Then, the temperature distribution at the distal end of the sheath, which is important for the heat generating characteristics of the glow plug, becomes poor, and the red heating of the distal end cannot be achieved, providing a problem in terms of functions.

SUMMARY OF THE INVENTION

It is an object of the present invention to provide a glow plug for a diesel engine, which can be applied to a cylinder head having a large number of valves to cope with exhaust gas control.

In order to achieve the above object, according to the present invention, there is provided a glow plug for a diesel engine, comprising a first helical resistor serving as a heater element, a second helical resistor connected in series with the first helical resistor to serve as a controller for controlling power supply to the first helical resistor, the second helical resistor having a positive temperature coefficient of resistance larger than that of the first helical resistor, a sheath for accommodating the first and second helical resistors to be embedded in a heat-resistant insulating powder, the sheath having an elongated small-diameter portion on a distal end side thereof and a large-diameter portion on a rear end side thereof, and the first helical resistor being connected to an inner wall of a distal end of the small-diameter portion of the sheath, an electrode rod having a distal end portion to which one end of the second helical resistor is connected, and a cylindrical housing for supporting the rear end portion of the sheath on the distal end side thereof, and the electrode rod, wherein the first helical resistor is disposed in a distal end portion of the small-diameter portion of the sheath, and the second helical resistor is disposed to extend from the small-diameter portion to the large-diameter portion of the sheath.

DESCRIPTION OF THE PREFERRED EMBODIMENT

The present invention will be described in detail with reference to the accompanying drawings.

Figure 1:
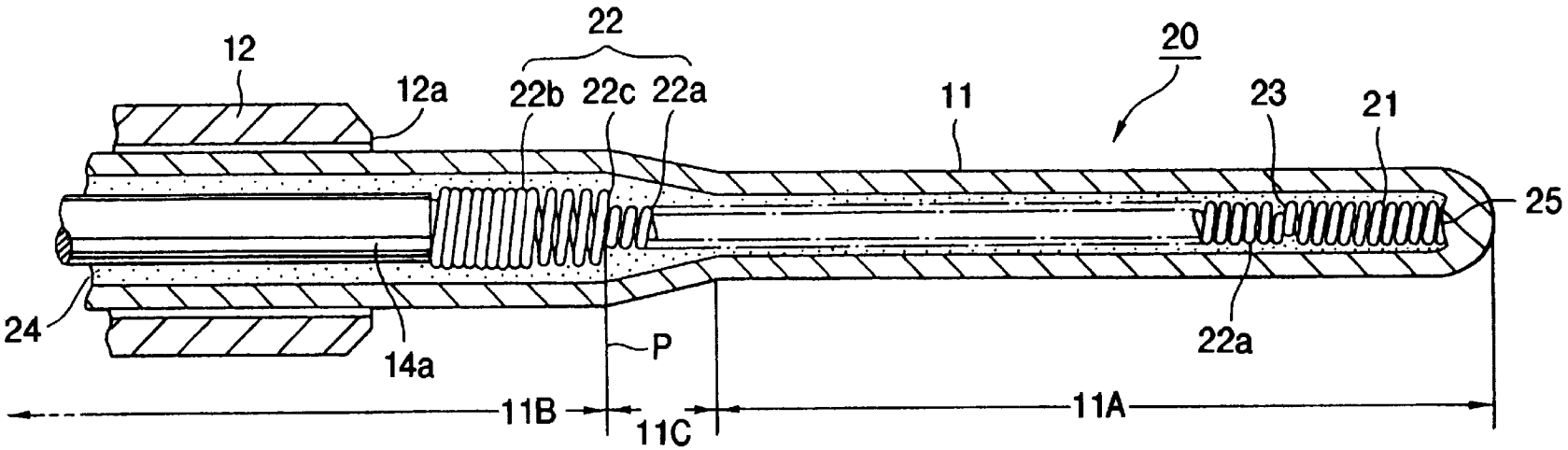
FIG. 1 is an enlarged sectional view of a sheath heater portion shown in FIG. 2.
Figure 2:
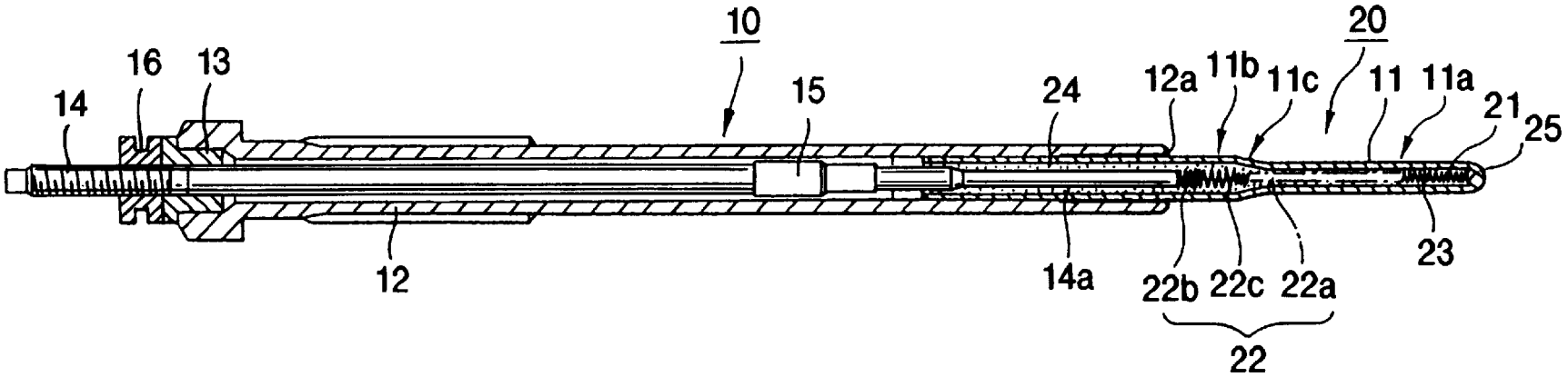
FIG. 2 is a sectional view showing a glow plug for a diesel engine according to an embodiment of the present invention.

FIGS. 1 and 2 show a glow plug for a diesel engine according to an embodiment of the present invention. Referring to FIG. 2, reference numeral 10 denotes the entire portion of the diesel engine glow plug. The glow plug 10 has a stepped sheath 11 made of a heat-resistant metal material, and a cylindrical housing 12 for holding the sheath 11 at its distal end portion. The sheath 11 has a small-diameter portion 11A on its distal end side, a large-diameter portion 11B on its rear end side, and a taper portion 11C for coupling the small-diameter portion 11A and the large-diameter portion 11B. A stepped electrode rod 14 is coaxially attached to the rear end portion of the housing 12 through an insulating bush 13. A distal end portion 14*a* of the electrode rod 14 is inserted in the large-diameter portion 11B of the sheath 11.

A distal end portion 12*a* of the housing 12 abuts against a seat portion formed in a plug holding hole of the cylinder head of a diesel engine (not shown), thus constituting a seat portion that achieves airtightness. Reference numeral 15 denotes an insulating tube fitted on the outer circumferential surface of the stepped portion of the electrode rod 14; 16, a nut threadably engaged with a threaded portion formed on the rear end portion of the electrode rod 14 projecting from the rear portion of the housing 12.

A first helical resistor (to be referred to as a heat generating coil hereinafter) 21 is disposed in a space at the distal end portion of the small-diameter portion 11A of the sheath 11 in the axial direction. The heat generating coil 21 serves as a heater element made of a conductive material, e.g., an iron-chromium alloy material (Fe—Cr alloy material) or a nickel-chromium alloy material (Ni—Cr alloy material), having a comparatively small positive temperature coefficient of resistance. One end of the heat generating coil 21 is electrically connected to the inner wall 25 of the distal end portion of the small-diameter portion 11A of the sheath 11. A second helical resistor (to be referred to as a control coil hereinafter) 22 is disposed in a space of the sheath 11 extending from the rear end portion of the small-diameter portion 11A to the distal end portion of the large-diameter portion 11B, between the heat generating coil 21 and the distal end portion 14*a* of the electrode rod 14 inserted in the sheath 11. The control coil 22 serves as a controller made of a conductive material, e.g., a cobalt-based alloy material, having a large positive temperature coefficient of resistance.

The control coil 22 has one end electrically connected to the other end of the heat generating coil 21 through a connecting portion 23, and the other end electrically connected to the distal end portion 14*a* of the electrode rod 14. More specifically, the heat generating coil 21 and the control coil 22 are incorporated in the sheath 11 while they are connected to each other in series, and are arranged between the inner wall 25 of the distal end portion of the sheath 11 and the distal end portion 14*a* of the electrode rod 14, thereby constituting a sheath heater 20. The two coils 21 and 22 are embedded in a heat-resistant insulating powder 24, e.g., magnesia (MgO), filled in the sheath 11.

At the connecting portion 23 connecting the two coils 21 and 22, as shown in FIG. 1, the helical end portions of the respective coils 21 and 22 are in contact with each other and connected by welding. The connecting portion 23 of the coils 21 and 22 may sufficiently be obtained by a conventionally known connecting scheme. For example, the two coils 21 and 22 may be connected through a separate connection member, or may be connected by threadably engaging the densely wound portions formed at the end portions of the coils 21 and 22 with each other.

Figure 4A:
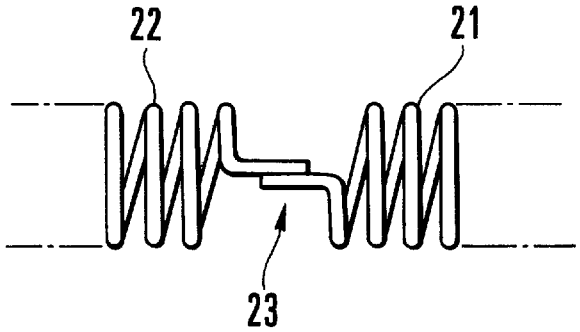
FIGS. 4A and 4B are schematic views respectively showing other examples of a connecting portion between the first and second resistors of the sheath heater shown in FIG. 1.
Figure 4B:
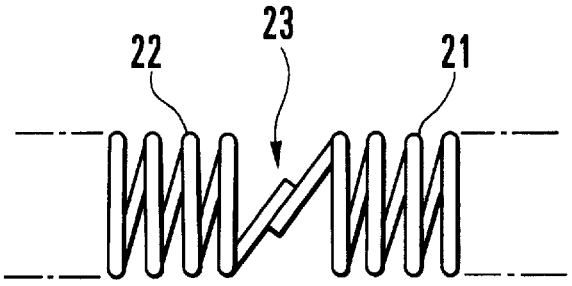

As practical examples of the connecting portion 23 of the two coils 21 and 22, as shown in FIGS. 4A and 4B, the connection ends may be extended from the ends of the helical portions of the coils 21 and 22 straightly in the axial direction or oblique direction to oppose each other, and these connection ends may be bonded by welding. As shown in these examples, when a gap is positively formed between the ends of the helical portions of the coils 21 and 22, the influence of heat generated by the heat generating coil 21 acts on the control coil 22 with a time lag. Therefore, control of power supply to the heat generating coil 21 by means of the control coil 22 can be set in a predetermined state (condition), and appropriate heat generating characteristics of the sheath heater 20 can thus be obtained.

As shown in FIG. 1, the control coil 22 is constituted by a small-diameter portion 22*a* to be connected to the heat generating coil 21, a large-diameter portion 22*b* to be connected to the electrode rod 14, and a coupling portion 22*c* for coupling the small-diameter portion 22*a* and the large-diameter portion 22*b*. The small-diameter portion 22*a* of the control coil 22 is arranged, together with the heat generating coil 21, in the small-diameter portion 11A of the sheath 11 to serve as an effective portion that controls power supply to the heat generating coil 21. In this structure, when incorporating the heat generating coil 21 and the control coil 22 connected to each other in series in the stepped sheath 11, part of the control coil 22 is arranged in the small-diameter portion 11A of the sheath 11, so that the control function of the control coil 22 will not be adversely affected. Accordingly, control of power supply to the heat generating coil 21 is appropriately performed by the control coil 22, and the distal end of the sheath 11 is heated in red and power supply to the heat generating coil 21 is controlled by the control coil 22. In other words, the glow plug 10 can function as a fast-heating type, self-temperature control type device.

Since the heat generating coil 21 is arranged only in the distal end portion of the elongated small-diameter portion 11A of the sheath 11, the distal end of the sheath heater 20 can be quickly heated in red. When the temperature distribution at the distal end of the sheath heater 20 is set in a desired state, preheating and after-glow by the glow plug 10 can be performed appropriately.

Figure 3:
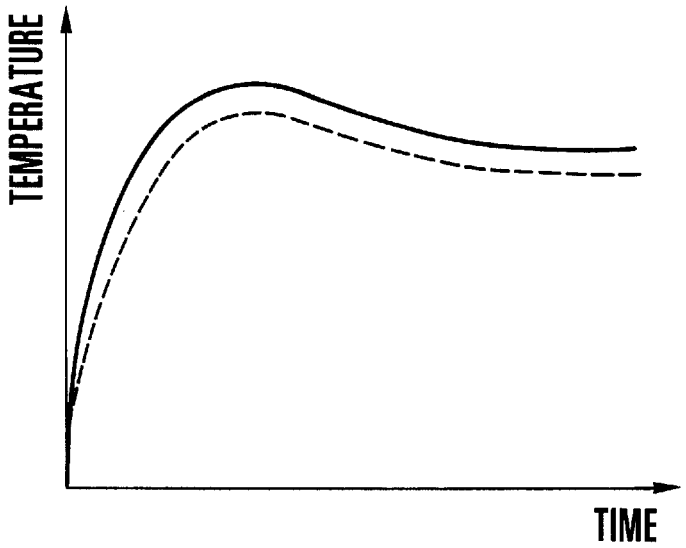
FIG. 3 is a graph for explaining the heat generating characteristics of the glow plug for the diesel engine shown in FIG. 2.

In FIG. 3, the solid line indicates the heat generating characteristics of the present invention, and the broken line indicates the heat generating characteristics obtained when the heat generating coil 21 is extended in the elongated small-diameter portion 11A. As shown in FIG. 3, according to the present invention, the temperature of the heat can be increased to a predetermined value more appropriately within a shorter period of time than in a conventional case, and overshoot characteristics can also be obtained appropriately.

According to the present invention, in the sheath heater 20 of the glow plug 10 that can serve as the fast-heating type, self-temperature control type device, the length of the small-diameter portion 11A on the distal end side of the sheath 11 can be increased to 1.5 times or more that of the conventional case.

The length of the small-diameter portion required for a cylinder head for exhaust gas control described above is 3 to 14 times or more (e.g., about 7 to 8 times) the sheath diameter of the small-diameter portion. In the conventional sheath heater in which the heat generating characteristics comprising fast-heating characteristics and overshoot characteristics are improved, the length of the small-diameter portion is about 2 to 2.5 times the sheath diameter of the small-diameter portion. The conventional sheath heater cannot be applied to a cylinder head for exhaust gas control, whereas the sheath heater of the present invention can be applied to it since its small-diameter portion 11A has a length well over 1.5 times that of the conventional case.

For example, the conventional small-diameter portion has a sheath diameter of about 3.5 mm and a length of about 8 mm. A portion that must have the maximum temperature when heated ranges from the distal to a position about 3 to 4 mm. However, it is demanded by the cylinder head for exhaust gas control that the axial length of the small-diameter portion of the sheath be set to about 12 to 40 mm. According to the present invention, the sheath heater 20 that ensures the heat generating characteristics as the glow plug 10 and has the length corresponding to that of the small-diameter portion 11A required by the cylinder head for exhaust gas control can be realized.

More specifically, the glow plug 10 of the present invention may be mounted on the cylinder head cover of a diesel engine (not shown). The elongated small-diameter portion 11A of the sheath heater 20 may be inserted in the holding hole formed in the cylinder head and the small-diameter insertion hole continuous with the holding hole to oppose the combustion chamber or the sub-combustion chamber of the engine. When mounting the cylinder head, the seat portion 12*a* at the distal end of the housing 12 of the glow plug 10 is sealed by the seat portion formed in the holding hole of the cylinder head, thereby maintaining airtightness of the combustion chamber and the like. The seat portion 12*a* may be located closer to the rear end of the large-diameter portion 11B of the sheath heater 20, or closer to the front end than the large-diameter portion 11B, e.g., the rear end portion of the taper portion 11C or the small-diameter portion 11A.

The control coil 22 is constituted by the small-diameter portion 22*a* formed to match the diameter of the small-diameter portion 11A of the sheath 11, and the large-diameter portion 22*b* continuous to the small-diameter portion 22*a*. The rear end portion of the small-diameter portion 22*a* of the control coil 22 is located near a coupling point (indicated by reference symbol P in FIG. 1) of the taper portion 11C and the large-diameter portion 11B, or on the small-diameter portion 11A closer to the rear end than the coupling point P.

When the control coil 22 is constituted in this manner, the small-diameter portion 22*a* of the control coil 22 is located in the taper portion 11C of the sheath 11. Thus, the control coil 22 can be embedded in the sheath 11 without short-circuiting the sheath 11 and the control coil 22. When manufacturing the sheath 11 having the small-diameter portion 11A, the large-diameter portion 11B, and the taper portion 11C in accordance with swaging, even if the dimension near the taper portion 11C varies, since the heat generating coil 21 is not disposed near the taper portion 11C, the influence on the heat generating characteristics can be comparatively decreased.

Regarding the control coil 22, the resistance that cannot be sufficiently obtained with only the small-diameter portion 22*a* is ensured by the large-diameter portion 22*b*, and such a large-diameter portion 22*b* is directly connected to the distal end portion 14*a* of the electrode rod 14 inserted in the rear end side of the sheath 11. Thus, the improvement of only the sheath 11 suffices. Accordingly, the electrode rod 14 can be shared by other types of glow plugs whose distal end portions have short sheaths.

When this arrangement is employed, the durability of the control coil 22 can also be improved. To describe this in more detail, the control coil 22 can be easily designed while considering a rise in voltage applied to the glow plug 10 in the after-glow time after the engine is started. In other words, the small-diameter portion 22*a* of the control coil 22 in the small-diameter portion 11A of the sheath 11 has a small mass and its temperature easily rises accordingly. For this reason, the design is performed to be able to suppress the temperature to such a value that can ensure the durability even in the after-glow time. More specifically, the resistance is set to match the mass, or the coil pitch is increased to be larger than the large-diameter portion 22*b*.

The large-diameter portion 22*b* of the control coil 22 in the large-diameter portion 11B of the sheath 11 has a large mass and its temperature is difficult to rise. Accordingly, the outer diameter of the coil is increased to ensure a resistance matching the mass, and pitch is also set appropriately. In the control coil 22 designed in this manner, overheating of the small-diameter portion 22*a* is prevented, so that the large-diameter portion 22*b* can function effectively.

Figure 5A:
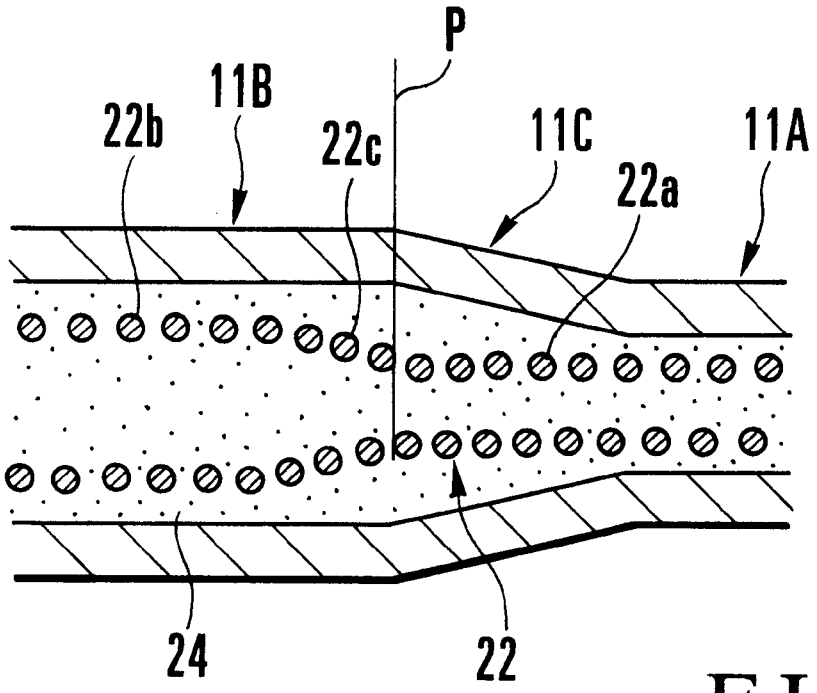
FIGS. 5A and 5B are enlarged sectional views showing other examples of the relationship in arrangement between the coupling portion of the small-diameter and large-diameter portions of the second resistor, and the small-diameter portion, the taper portion, and the large-diameter portion of the sheath.
Figure 5B:
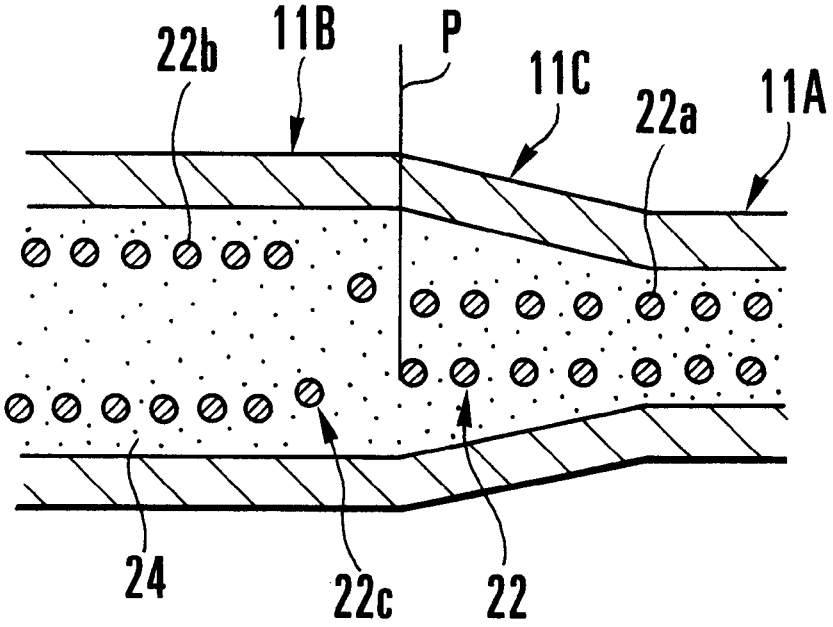

In this embodiment, the small-diameter portion 22*a* and the large-diameter portion 22*b* of the control coil 22 are coupled through the coupling portion 22*c* having a diameter which increases via steps, as shown in FIG. 1. However, the present invention is not limited to this. For example, a small-diameter portion 22*a* and a large-diameter portion 22*b* may be continuously formed through a coupling portion 22*c* wound at the same pitch as that of the small-diameter and large-diameter portions 22*a* and 22*b*, as shown in FIG. 5A, or through a coupling portion 22*c* wound at a pitch larger than that of the small-diameter and large-diameter portions 22*a* and 22*b*, as shown in FIG. 5B. Therefore, the coupling portion 22*c* of the control coil 22 may be set to substantially coincide with the coupling point P of the taper portion 11C and large-diameter portion 11B of the sheath 11, or may be located on the rear end side of the sheath 11 than the coupling point P.

The present invention is not limited to the structure of the embodiment described above, and the shapes, the structures, and the like of the respective portions of the glow plug 10 can be freely changed or modified. For example, as the structure of the glow plug 10 of a device other than the sheath heater 20, various types of modifications are possible, as is conventionally known widely.

As has been described above, according to the glow plug for the diesel engine of the present invention, the function and durability of the sheath heater as the fast-heating type, self-temperature control type device can be ensured, and simultaneously the small-diameter portion at the distal end of the sheath heater is increased to be longer than that of the conventional case, so that an increase in number of valves of the diesel engine for exhaust gas control can be coped with.

What is claimed is:

1. A glow plug for a diesel engine, comprising:

a first helical resistor serving as a heater element;

a second helical resistor connected in series with said first helical resistor said second helical resistor having a positive temperature coefficient of resistance larger than that of said first helical resistor, and said second helical resistor controlling power supply to said first helical resistor;

a sheath enclosing said first and second helical resistors in a heat-resistant insulating powder, said sheath having an elongated small-diameter portion on a distal end side thereof and a large-diameter portion on a rear end side thereof, one end of said first helical resistor being connected to a distal end inner wall of said small-diameter portion of said sheath;

an electrode rod having a distal end portion to which one end of said second helical resistor is connected; and a cylindrical housing for supporting said large-diameter portion on a rear end side of said sheath, and said electrode rod, wherein said first helical resistor is disposed in a distal end portion of said small-diameter portion of said sheath, said second helical resistor is disposed from said small-diameter portion to said large-diameter portion of said sheath, and said second helical resistor is connected to said first helical resistor at the distal end side of said small-diameter portion.

2. A plug according to claim 1, wherein said second helical resistor has a small-diameter portion corresponding to a diameter of said small-diameter portion of said sheath and a large-diameter portion corresponding to a diameter of said large-diameter portion of said sheath, said small-diameter portion of said second helical resistor disposed in said small-diameter portion of said sheath together with said first helical resistor, and said large-diameter portion of said second helical resistor arranged in said large-diameter portion of said sheath.

3. A plug according to claim 2, wherein a rear end portion of said small-diameter portion of said second helical resistor is arranged on said rear end side of said sheath and includes a coupling portion between said small-diameter portion and said large-diameter portion of said sheath.

4. A plug according to claim 3, wherein said sheath has a taper portion at least partially defining said coupling portion.

5. A plug according to claim 1, wherein said second helical resistor has a taper coupling portion a small-diameter portion, and a large-diameter portion, wherein said taper coupling portion of said second helical resistor is at least partially defined between said small-diameter portion and said large-diameter portion of said second helical resistor, and said taper coupling portion of said second helical resistor has a winding pitch not less than that of said small-diameter and large-diameter portions of said second helical resistor.

6. A plug according to claim 1, further comprising a connecting portion for electrically connecting opposing helical end portions of said first and second helical resistors, and wherein said second helical resistor controls power supply to said first helical resistor through said connecting portion.

7. A plug according to claim 6, wherein said first and second helical resistors have connecting ends extending in one of a straight axial direction and an oblique direction at said opposing helical end portions thereof, and said connecting portion connects said first and second helical resistors at a predetermined gap by welding said connecting ends of said first and second helical resistors.

8. A plug according to claim 1, wherein said small-diameter portion of said sheath has a length not less than three times a diameter thereof.

9. A plug according to claim 8, wherein when said small-diameter portion of said sheath has a diameter of 3.5 mm, said small-diameter portion has a length of 12 to 40 mm.

10. A glow plug comprising:

a sheath defined by a small-diameter distal portion and a large-diameter portion;

a first coil disposed entirely within said small-diameter distal portion of said sheath; and a second coil, coupled to said first coil, said second coil having a first portion disposed in said large-diameter portion of said sheath, and a second portion extending into said small-diameter portion of said sheath.

11. The glow plug of claim 10, wherein said first coil is coupled at one end to an inner wall of said small-diameter distal portion of said sheath.

12. The glow plug of claim 10, further comprising:

an electrode, coupled to said second coil, to provide power to said first coil.

13. The glow plug of claim 10, wherein said first and second coils are embedded in a heat-resistant insulating material.

14. A glow plug for a diesel engine, the glow plug comprising:

a sheath having a first portion having a diameter and a cap end, a second portion having a diameter that is greater than the diameter of the first portion, and a tapered portion fixed to the first portion at a first coupling point and fixed to the second portion at a coupling point P;

a heating coil disposed within within the sheath first portion and electrically coupled to the cap end;

a control coil having a coupling portion disposed between a first control and a second control, the first control disposed at least within the sheath first portion and coupled at a first end to the heating coil, the first control having a second end coupled to the coupling portion adjacent to the coupling point P; and a rod disposed within the sheath and coupled to the second control of the control coil.

15. The glow plug of claim 14, the sheath first portion having an axial length that is at least 3 times the diameter of the sheath first portion.

16. The glow plug of claim 15, the sheath first portion having an axial length that is at least 6 times the diameter of the sheath first portion.

17. The glow plug of claim 16, the sheath first portion having an axial length of 12 mm to 40 mm.

18. The glow plug of claim 14, further comprising:

a housing disposed about the sheath, the housing having a seat end located a linear space from the coupling point P.

19. The glow plug of claim 14, the first control having a diameter that equals a heating coil diameter.

20. The glow plug of claim 14, the first control disposed within the sheath second portion.

21. The glow plug of claim 20, the first end of the first control extending on one of a straight axial direction and an oblique direction to the heating coil and welded to the heating coil to form a gap between the first control and the heating coil.

22. The glow plug of claim 14, the coupling portion having a variable diameter wherein the variable diameter of the coupling portion increases in steps from the first control to the second control.

23. The glow plug of claim 14, the coupling portion having a variable diameter wherein the variable diameter of the coupling portion is formed from a pitch that is at least equal to at least one of a pitch of the first control and a pitch of the second control.

24. The glow plug of claim 14, the coupling portion having a variable diameter wherein the variable diameter of the coupling portion is formed from a pitch that is greater than at least one of a pitch of the first control and a pitch of the second control.

25. The glow plug of claim 14, the second control having a diameter that is greater than the diameter of the first control.

26. The glow plug of claim 25, the second control having a pitch that is less than a pitch of the first control.

27. The glow plug of claim 14, the control coil formed from a continuous wire.

* * * * *

UNITED STATES PATENT AND TRADEMARK OFFICE

CERTIFICATE OF CORRECTION

PATENT NO. : 6,037,568

DATED : March 14, 2000

INVENTOR(S) : Hatanaka et al.

It is certified that error appears in the above-identified patent and that said Letters Patent is hereby corrected as shown below:

On the Title Page, Item

In [57] delete the entire paragraph and insert --A glow plug for a diesel engine. A heat generating coil is disposed at a distal end of a sheath associated with the glow plug, wherein the distal end defines a relatively small-diameter portion of the sheath. A first end of the heat generating coil is connected to an inner wall of the distal end. A controller coil, disposed at a relatively larger-diameter portion of the sheath, is connected in series with the heat generating coil. The controller coil extends from the relatively larger-diameter portion to the relatively smaller-diameter portion. The controller coil is further connected at one end to an electrode rod. --.

In column 8, line 9, delete "disposed in a distal" and insert -- disposed entirely within a distal --.

In column 8, line 62, delete "A glow plug comprising:" and insert -- A glow plug, comprising: --.

In column 9, line 2, delete "disposed in said" and insert -- disposed entirely within said --.

In column 9, line 4, delete "sheath." and insert -- sheath, wherein said second portion of said second coil is coupled to said first coil at a distal end of said small-diameter distal portion. --.

In column 9, line 26, delete "at a first end" and insert -- at an end --.

In column 9, line 26, delete "to the" and insert -- to an end of the --.

UNITED STATES PATENT AND TRADEMARK OFFICE

CERTIFICATE OF CORRECTION

PATENT NO. : 6,037,568

DATED : March 14, 2000

INVENTOR(S) : Hatanaka et al.

It is certified that error appears in the above-identified patent and that said Letters Patent is hereby corrected as shown below:

In column 9, line 26, delete "coil, the first" and insert -- coil, at a distal point within the sheath first portion, the second control disposed within the sheath second portion and coupled to a rod, wherein a transition point between, the first --.

In column 9, line 27, delete "having a second end coupled to" and insert -- and --.

In column 9, line 28, delete "adjacent to" and insert -- is adjacent to --.

In column 9, line 28, delete "; and a rod disposed within the sheath and coupled to the second control of the control coil." and insert -- . --.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*